United States Patent [19]

Saunders

[11] 4,040,282

[45] Aug. 9, 1977

[54] IRONING RING HAVING IMPROVED LUBRICATING CHARACTERISTICS

[75] Inventor: William T. Saunders, Weirton, W. Va.

[73] Assignee: National Steel Corporation, Pittsburgh, Pa.

[21] Appl. No.: 634,518

[22] Filed: Nov. 24, 1975

[51] Int. Cl.[2] ..... B21D 22/28

[52] U.S. Cl. ..... 72/41; 72/349; 72/467

[58] Field of Search ..... 72/41, 43, 44, 347, 72/348, 349, 467, 468, 469

[56] References Cited

U.S. PATENT DOCUMENTS

| | | | |
|---|---|---|---|
| 2,821,156 | 1/1958 | Lyon | 72/348 |
| 2,971,644 | 2/1961 | Sejournet | 72/41 |
| 3,670,543 | 6/1972 | Bolt et al. | 72/41 |
| 3,705,509 | 12/1972 | Haller | 72/467 X |
| 3,780,553 | 12/1973 | Athey | 72/41 |
| 3,930,396 | 1/1976 | Martinez | 72/347 |
| Re. 23,095 | 3/1949 | Keller | 72/349 |

FOREIGN PATENT DOCUMENTS

| | | | |
|---|---|---|---|
| 135,268 | 11/1946 | Australia | 72/348 |
| 453,878 | 1/1949 | Canada | 72/43 |
| B31,369 | 11/1956 | Germany | 72/347 |
| 666,565 | 10/1938 | Germany | 72/43 |

*Primary Examiner*—E. M. Combs

*Attorney, Agent, or Firm*—Shanley, O'Neil and Baker

[57] ABSTRACT

An ironing ring for use in the manufacture of drawn and ironed unitary sheet metal can bodies made from flat rolled steel blackplate. The interior working surface of the ironing ring is treated by diamond wheel grinding, or the like, to form fine-line indentations which decrease the surface contact of the ironing ring with the metal surface being ironed. The linearly extended indentations extend over the entry portion of the ring to, or into, the dwell portion of the ring and help draw ironing lubricant into the ring during the ironing operation.

4 Claims, 6 Drawing Figures

FIG. 1
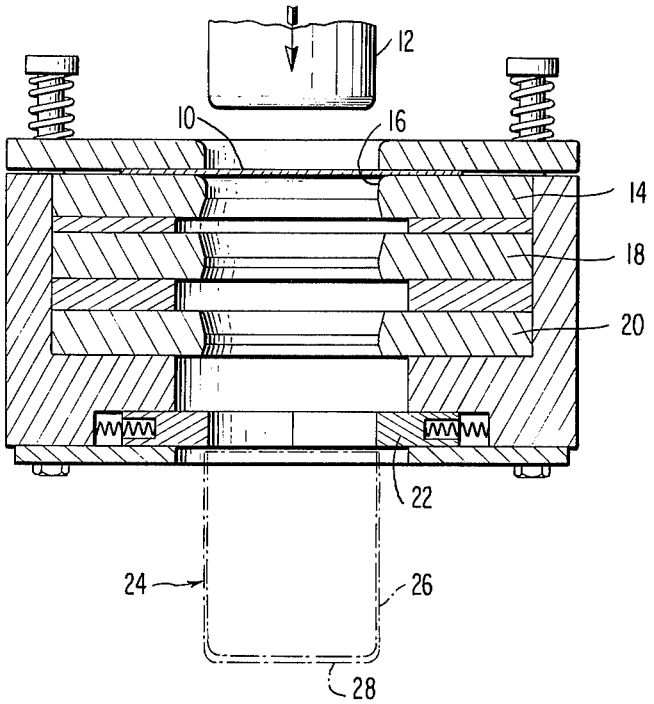
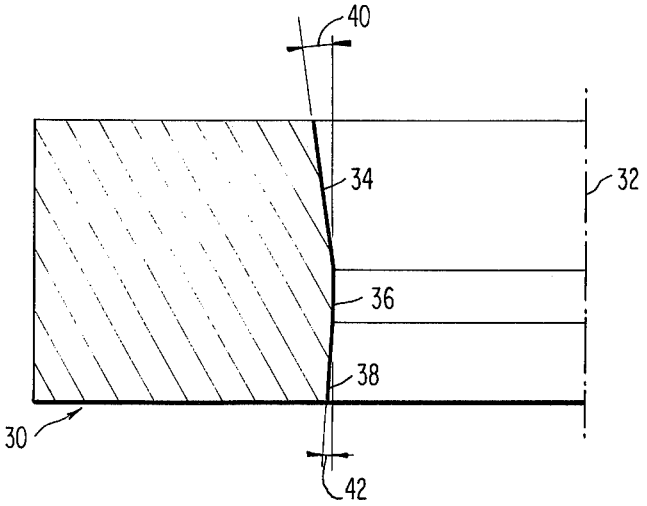
FIG. 2
FIG. 3
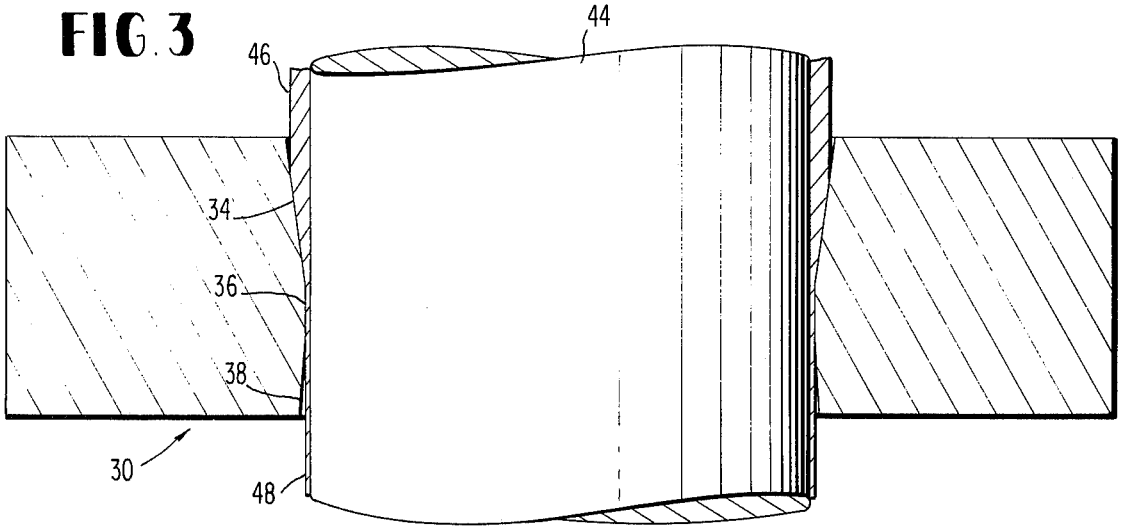

IRONING RING HAVING IMPROVED LUBRICATING CHARACTERISTICS

This invention is concerned with ironing the sidewall of a unitary can body made from flat rolled steel blackplate. More particularly, the invention is concerned with an ironing ring having characteristics which improve lubricant holding properties and decrease surface contact between the can body sidewall and the working surface of the ironing ring.

"Ironing" is a term applied to the process of elongating and thinning the sidewall of a cup-shaped article having a unitary bottom wall. The process is applied in the manufacture of unitary can bodies for use in the fabrication of beverage containers. In the ironing process a cup-shaped article, mounted on an ironing mandrel, is driven through circular cross section ironing ring means mounted concentrically with the ironing mandrel. Additional description of a conventional ironing process can be found in the patent to Bolt et al. U.S. Pat. No. 3,670,543.

The ability to iron can body sidewalls is important in container manufacture for reasons of economy and conservation of material; the ironing process permits manufacture of a two-piece container (can body and lid) thus eliminating the sidewall seam and one chime seam while substantially decreasing the amount of sheet metal required. As an example of the latter, flat rolled steel sheet metal ironed to a thickness gage of about 0.0025–0.0045 inch (about 0.065–0.115 mm) is adequate for two-piece carbonated beverage containers; whereas, formerly, the sidewalls of three-piece beverage containers varied between about 0.006 (0.152 mm) and 0.008 (0.203 mm).

The movement of metal during ironing of a steel can body sidewall involves application of considerable force to the sheet metal. A particular problem arising with the forces required is proper lubrication. Numerous approaches to this problem, some of which can be helpful for selected materials, have been attempted. One teaching (U.S. Pat. No. 3,360,157) advocates use of matte-surface electrotinplating on steel, i.e., a non-reflowed electroplated tin coating to aid lubrication. Another teaching (U.S. Pat. No. 3,670,543) advocates roughening of the exterior surface of a cup-shaped article before ironing.

As has been recognized blackplate presents special problems because its non-coated steel surface does not provide the lubricating properties available from a softer metal, such as tin. Also, the large forces required to iron steel, which is the hardest of the metals generally used to make can bodies, cause substantially complete removal of lubricant from the blackplate surface. Therefore in commercial practice, ironing of can body products from softer metals such as aluminum, or soft metal coated steel has been favored. Yet blackplate is the most economical of the available sheet metal container stocks and is the otherwise satisfactory for can bodies. The present invention makes use of steel blackplate commercially practical for the manufacture of ironed sidewall unitary can bodies.

Other concepts and contributions will be more evident from description of the invention presented with the accompanying drawings, in which:

FIG. 1 is a schematic cross-sectional view of apparatus for drawing and ironing a can body;

FIG. 2 is a schematic radial cross-sectional view of a portion of an ironing ring of the present invention;

FIG. 3 is a scehmatic diametral cross-sectional view of the ironing ring of the present invention during the ironing process showing the reduction in sidewall sheet metal thickness during ironing;

Figure 4:
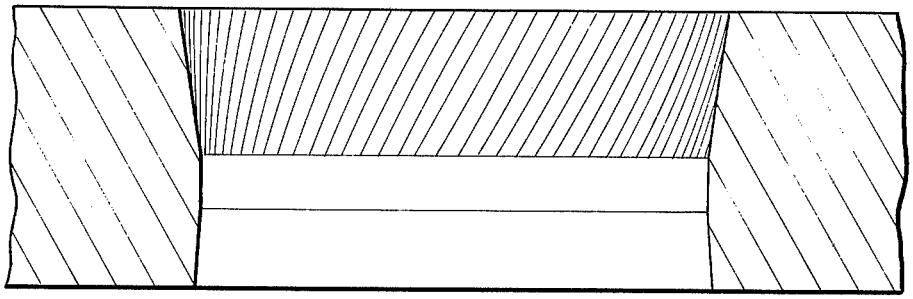
FIG. 4 is a schematic view, partially in elevation and partically in cross section of an ironing ring, showing features of the present invention.

During an ironing operation as shown in FIG. 1, blank 10 is acted on by the downward movement of mandrel 12 during its work stroke. The mandrel moves along a path having the same direction as its longitudinal axis and, the latter is coincident with the central axis of the working surfaces encountered. Although a cup-shaped article can be preformed in another machine, in the apparatus shown a cup is formed by drawing tool means 14 which presents rounded work surface 16. The drawn cup is then driven through rings 18 and 20. Upon the return stroke of mandrel 12, stripper 22 removes the drawn and ironed can body from the mandrel. As shown in dotted lines, the ironed can body 24 has an elongated and thinned sidewall 26 and a bottom wall 28 having substantially the original thickness of blank 10.

FIG. 2 shows a cross-sectional view of one segment of an annular ironing ring embodying the invention. The working surfaces of annular ironing ring 30 are symmetrically disposed about its longitudinally extending central axis 32, which axis is coincident with the longitudinal axis of an ironing mandrel during use. The internal working surface of the ironing ring 20 is divided into three parts, entry portion 34, dwell portion 36 and exit portion 38 which are confronted in that order by the external surface of a mounted can body during the work stroke of an ironing mandrel.

Entry portion 34 has a truncated conical configuration with its largest diameter opening in the direction of approach of the ironing mandrel during its working stroke and, its smaller diameter opening contiguous to the dwell portion 36 of ironing ring 30. As shown by the intersection of a radial plane extending from the central axis 32, the surface of entry portion 34 has an angular relationship with the central axis, such angular relationship is defined by angle 40. This angle can have a value from about 5° to about 15° but is preferable around 7½° for ironing of conventional carbonated beverage can bodies.

Dwell portion 36 has a cylindrical configuration and extends between the entry portion 34 and the exit portion 38.

The interior surface of exit portion 38 has a truncated conical configuration with its smallest diameter being contiguous to dwell portion 36, i.e., in the direction of approach of the mandrel during its working stroke through the ironing ring 30. The angle 42 of this "relief" surface 38 is less than about 5°, generally about 2° for use in ironing sidewalls for standard size carbonated beverage container can bodies.

During the ironing operation a can body sidewall is reduced in thickness as the unitary can body is driven through an ironing ring while mounted on an ironing mandrel. In the cross-sectional view of FIG. 3, a cup-shaped article mounted on mandrel 44 is being driven through the ironing ring 30 which embodies the invention. Sidewall sheet metal 46, of greater thickness before entry, is reduced in thickness by passage through ring 30 to that of ironed sidewall 48. The work involved in reducing the sidewall thickness is performed substantially completely by the entry portion 34 of the ring. The dwell portion 36 of the interior surface of the ironing ring 30 supports the entry portion. Exit portion 38 is shaped to prevent any binding of the metal after exit from dwell portion 36.

When ironing a hard metal such as steel blackplate, the forces required act to preclude or squeeze-out lubricant from between the working surface of the ring and the surface of the can body being worked. Absence of lubricant can cause non-uniform stretching or tearing of the sheet metal. The unique approach of the present invention solves this problem by forming the ironing ring to draw lubricant into the ring rather than exclude it. A film of oil is maintained between the working surface of the tool and the sheet metal surface being worked and the surface contact between the two is decreased. These unusual results are accomplished by treating the surface of the entry portion of the ironing ring to develop characteristics at that surface which reduce working surface contact and maintain a lubricant film.

The desired results of decreasing surface contact and maintaining a lubricant between the working surface and the surface being worked are obtained by treating at least the entry portion of the ring to form a series of fine-line depressions, i.e., lineraly extended indentations, on that working surface. These reduce the area of surface contact and act as reservoirs for the lubricant which is drawn down into the ironing ring. These depressions extend to the dwell portion of the ring and, need not extend into the dwell portion for a workable embodiment. However, such depressions can be extended into the dwell portion during manufacture and enhance the performance of the ring.

In practice the linearly extended indentations are formed on the entry portion of the ring by a spinning tool with embedded grinding or cutting particles suitable for cutting such linearly extended impressions in the tool material from which the ironing ring is made. Typically, such tool material is a carbide and the conventional ironing ring materials, e.g., those suitable for ironing tin plated steel, can be used in the present invention; similarly the overall dimensional characteristics of the conventional ironing ring are not changed by the present invention so that the rings of the present invention can be used in conventional ironing apparatus.

FIG. 4 shows a schematic representation of what is considered to be the effect of the fine-line indentation teachings, i.e., helical grooves in the surface of the entry portion of the ring which lead to the dwell portion of the ring. It has been found that, with the surface treatment taught by the invention, instead of lubricant being squeezed out of the tool by the ironing action, the lubricant is drawn down into the ring. The grinding action treatment taught has the same effect as if a plurality of closely spaced helical grooves were formed so as to guide lubricant down into the ring while the surface of the can body sidewall is worked by the intermediate peaks between grooves thus lessening surface contact.

In a specific embodiment of the grinding treatment taught an eccentrically-mounted spin-table grinder, having a grinding surface which includes embedded particles, such as industrial diamonds, is used to mark the working surface of the ironing ring as desired with fine-line impressions. A suitable apparatus for carrying out this operation is the Moore Precision Spin-Table manufactured by Moore Special Tool Company, Inc. of Bridgeport, Conn. Maintaining trueness of rotation for the ironing ring and precisely limiting axial deviation of the grinding tool enables uniform distribution of the desired impressions.

Diamonds, or other suitably hard particles, embedded in the grinding tool to provide approximately 100 grit surface, produce satisfactory results for beverage container can bodies. Standard grinding wheel surface data is presented in the American Standards Association publication B.5.17, 1958. The particles for a 100 grit surface are sized to pass through 0.0059 (0.1485 mm) square openings.

During the manufacture of an ironing ring in accordance with the invention, an ironing ring mounted on a spin table is rotated at about 15 to 20 rpm and the grinding wheel is moved into and out of the revolving ironing ring for between 5 and 10 strokes at a rate between 5 and 10 strokes per minute. The mounted ring is tilted to accommodate the angled entry portion.

The objectives in forming the fine-line impressions are to reduce the area of surface contact and to provide adequate reservoirs for lubricant. However, the grinding action to form such fine-line impressions is limited so as to avoid creating a smooth surface of a slightly larger diameter than at the start of the grinding operation.

Figure 5:
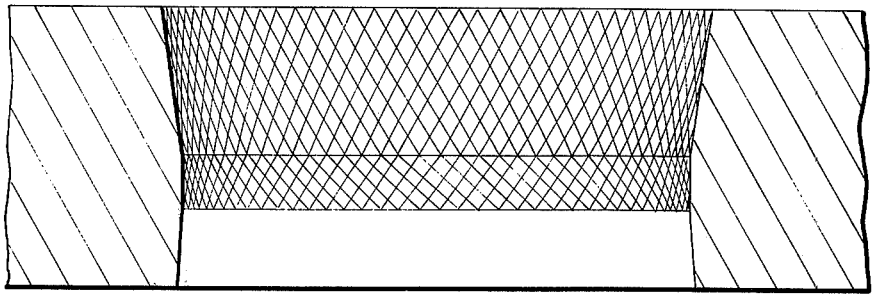
FIG. 5 is a view, partially in elevation and partially in cross section of an ironing ring, showing a specific embodiment of the present invention.

FIG. 5 is intended to represent the uniform pattern formed on the entry portion and dwell portion by the desired grinding action. In a specific embodiment, a 100 grit (diamond) grinding tool is rotated at 16,000 rpm. The ironing ring is rotated at 15 rpm; the grinding tool is moved through seven strokes into and out of the ring during a 1 minute interval. This produces a crosshatch of finely spaced helical lines presenting a center line average (CLA) of 35 micro inches (0.89 mm) and spaced about 0.030 inches (0.762 mm). These measurements were made with the surface condition measuring instrument known as the "TALYSURF" surface indicator. This instrument is manufactured by the Rank Organization, Leicester, England (Rank Taylor Hobson Div.) and distributed by Engis Equipment Company of Morton Grove, Ill. The TALYSURF indicator measures and records surface conditions electronically utilizing a sharply pointed stylus to trace the profile of the surface irregularities.

Figure 6:
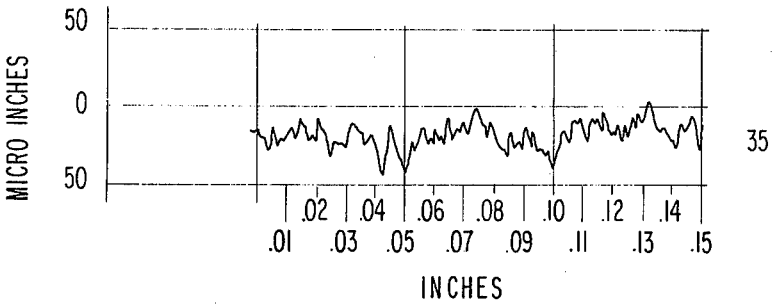
FIG. 6 is a graphical presentation of the measured surface condition of an embodiment of the invention such as that shown in FIG. 5.

FIG. 6 shows the graphical record of the profile of a cross section of the surface irregularities, measured by the TALYSURF indicator, for the above specific embodiment. As can be seen from this graph a highly uniform pattern of fine-line impressions is formed presenting a center line average (CLA) of 35 micro inches (0.89 mm). The center line (also known mathematically as the median line) is the line about which roughness is measured, and is a line parallel to the general direction of the profile, such that the sums of the areas contained between it and those parts of the profile which lie on either side of it are equal. Satisfactory results for ironing blackplate can be obtained with a surface having a CLA between about 20 micro inches (50 um) and 50 micro inches (1.25 um).

The closely-spaced, shallow depth linearly-extended indentations preferred as part of the present invention for ironing of blackplate without noticeably marking the sidewall surface are not suitable for commercial ironing of soft metals, such as aluminum, or soft metal coatings, such as tin, because such soft metals tend to fill the fine-line impressions and impede the function of such fine-line impressions as reservoirs for lubricant.

The angle of the ironing ring surfaces and the relative proportions of the surface areas of an ironing ring can vary within the teachings of the invention. The largest diameter of the entry portion must have a value which is slightly in excess of the outer diameter of the can body being ironed. The diameter of the dwell portion is approximately equal to the desired outer diameter of the can body after passage through that particular ring. Modifications of material and methods of creating the desired fine-line impressions can be made without departing from the concept of the present invention. Therefore, in determining the scope of the invention reference shall be had to the appended claims.

What is claimed is:

1. Improved ironing ring which facilitates ironing of flat rolled steel blackplate container stock in which ironing operation the sidewall of a unitary cup-shaped article is elongated and thinned by passage of the cup-shaped article, while mounted on an ironing mandrel, through an ironing ring concentrically mounted with respect to the ironing mandrel with the central axis of the ironing ring coincident with the longitudinal axis of the ironing mandrel, such ironing ring having a circular interior configuration in a cross-sectional plane which is perpendicular to the central axis of the ironing ring and longitudinal axis of the ironing mandrel during an ironing operation, such longitudinal axis being coincident with the direction of movement of the ironing mandrel, the ironing ring defining a plurality of surface areas along its interior surface confronting the cylindrical exterior surface of the ironing mandrel mounted cup-shaped article, such interior surface areas of the ironing ring being symmetrical with respect to the central axis and comprising an entry portion, a dwell portion, and an exit portion confronted in that order during a working stroke of the ironing mandrel, the entry portion of the ironing ring defining a truncated coincal configuration with its largest diameter in the direction of approach of the ironing mandrel on its working stroke, such entry portion interior surface having an angled relationship with such central axis of about 5° to about 15° at the intersection of such entry portion with a radial plane extending from the central axis of the ironing ring, the dwell portion of the ironing ring having a substantially cylindrical configuration, such interior surface area of the dwell portion extending longitudinally between the entry portion and the exit portion of the ironing ring, the exit portion of the ironing ring having a truncated conical configuration with its smallest diameter in the direction of approach of the ironing mandrel on its working stroke, such exit portion of the ironing ring having an internal surface having an angled relationship with the central axis of less than 5° to prevent binding of sheet metal as the ironing mandrel is driven through the ironing ring, such angled relationship existing at the intersection of such exit portion with a radial plane extending from the central axis of the ironing ring, such interior surface area of the entry portion of the ironing ring presenting fine-line indentations which act to hold surface lubricant during the working stroke of an ironing operation, such fine-line indentations extending over the surface area of the entry portion contacted by the cup-shaped article during the working stroke and extending toward the dwell portion of the ironing ring, and such fine-line indentations presenting a center line average of surface irregularities between about 20 and about 50 micro inches.

2. The ironing ring of claim 1 in which such fine-line indentations extend into the dwell portion of the ironing ring.

3. The ironing ring of claim 1 in which the fine-line indentations define a crosshatch helical pattern.

4. The ironing ring of claim 1 in which the fine-line indentations are cut into such entry portion by grinding means having approximately a 100 grit surface.

* * * * *